US010451346B1

(12) United States Patent
Nguyen

(10) Patent No.: US 10,451,346 B1
(45) Date of Patent: Oct. 22, 2019

(54) CONVECTION CURRENT FREEZE DRYING APPARATUS AND METHOD OF OPERATING THE SAME

(71) Applicant: VINAMIT USA LLC, Tigard, OR (US)

(72) Inventor: Vien Lam Nguyen, Ho Chi Minh (VN)

(73) Assignee: VINAMIT USA LLC, Tigard, OR (US)

( * ) Notice: Subject to any disclaimer, the term of this patent is extended or adjusted under 35 U.S.C. 154(b) by 0 days.

(21) Appl. No.: 16/371,097

(22) Filed: Mar. 31, 2019

(51) Int. Cl.
*F26B 5/06* (2006.01)

(52) U.S. Cl.
CPC ..... *F26B 5/065* (2013.01)

(58) Field of Classification Search
CPC ..... F26B 5/06; F26B 5/04; F26B 5/044; A61J 1/14; A61J 1/1468; A61L 2/084; A61L 2/085
USPC ..... 34/296
See application file for complete search history.

(56) References Cited

U.S. PATENT DOCUMENTS 3,199,217 A * 8/1965 Oldenkamp ..... A23L 3/44 34/144
3,245,152 A * 4/1966 Natelson ..... F25D 31/00 34/286
3,270,434 A * 9/1966 Hackenberg ..... F26B 5/06 34/284
4,177,577 A * 12/1979 Bird ..... F26B 5/06 34/92
5,884,413 A * 3/1999 Anger ..... F26B 5/06 34/92
6,068,874 A * 5/2000 Grocholski ..... A23B 4/031 34/196
6,199,297 B1 * 3/2001 Wisniewski ..... B65D 51/241 206/439
6,920,701 B2 * 7/2005 Haseley ..... F26B 5/06 34/92
8,544,183 B2 * 10/2013 Kuu ..... A61K 9/19 165/185
8,689,460 B2 * 4/2014 Kuu ..... F26B 5/06 34/287

(Continued)

FOREIGN PATENT DOCUMENTS

EP 3042674 B1 * 10/2018 ..... A61M 5/002
JP 4749328 B2 * 8/2011 ..... A61M 5/002

*Primary Examiner* — Stephen M Gravini

(57) ABSTRACT

A convection current vacuum freeze drying apparatus is disclosed which includes a dryer chamber unit comprising a plurality of trays for depositing products to be freeze dried; a convection current condenser unit, mechanically connected to the dryer chamber unit, comprising a plurality of first elongate heat exchange tubes each having fins arranged around an outer circumference of the first elongate heat exchange tube; a refrigerator unit mechanically connected to the convection current condenser unit, operable to provide cold temperature to the plurality of elongate heat exchange tubes; a cooling tower unit mechanically connected to the convection current condenser unit; a primary vacuum pump unit, mechanically connected to the convection current condenser unit and the cooling tower unit, operable to provide a vacuum pressure to said convection current condenser unit; and a heater unit mechanically connected to provide a heat energy to both the dryer chamber unit and the convection current condenser unit.

20 Claims, 6 Drawing Sheets

(56) References Cited

U.S. PATENT DOCUMENTS

| | | | | |
|---|---|---|---|---|
| 8,793,896 | B2 * | 8/2014 | Patel | G01N 21/68 165/185 |
| 8,966,782 | B2 * | 3/2015 | Kuu | F26B 5/06 34/287 |
| 8,984,763 | B2 * | 3/2015 | Savarese | F26B 3/28 34/266 |
| 9,003,676 | B2 * | 4/2015 | Yarborough | A61M 5/002 34/287 |
| 9,121,637 | B2 * | 9/2015 | Ling | G01K 17/00 |
| 9,528,761 | B2 * | 12/2016 | Kuu | F26B 5/06 |
| 9,625,210 | B2 * | 4/2017 | Kuu | F26B 5/06 |
| 9,739,532 | B2 * | 8/2017 | Baugh | F26B 5/06 |
| 9,869,513 | B2 * | 1/2018 | Kuu | F26B 5/06 |
| 10,113,797 | B2 * | 10/2018 | Dern | F25B 13/00 |

* cited by examiner

CONVECTION CURRENT FREEZE DRYING APPARATUS AND METHOD OF OPERATING THE SAME

CLAIM OF PRIORITY

This application is a continuation application of application Ser. No. 16/258,639, entitled "Fully Automatic Convection Current Freeze Drying Method", filed on Jan. 27, 2019. The patent application identified above is incorporated here by reference in its entirety to provide continuity of disclosure.

FIELD OF THE INVENTION

The present invention relates generally to vacuum freeze drying apparatus. More specifically, the present invention relates to a vacuum freeze drying apparatus using natural convection currents.

BACKGROUND ART

Food products are dehydrated to: (1) increase their shelf-life, and (2) to avoid the deterioration of aroma and flavour as well as nutrient degradation. This is because water is known to degrade food products by oxidization; infection by microorganisms; destruction of proteins, nutrients, and food enzymes; and destruction of the food colors, forms, and flavors. Vacuum freeze drying apparatuses are selected to remove water (dehydrate) from food products. Under the dehydration process of the vacuum freeze drying apparatuses (lyophilazation), water in the food products are removed under the low temperature and pressure condition.

There are four basic components to the conventional vacuum freeze drying apparatus. They are: a freeze dried chamber, a condenser unit, a refrigerator unit, and a vacuum pump unit. Each plays a vital role in the functionality of the conventional vacuum freeze drying apparatus. In the freeze dried chamber, products are either laid flat in trays or contained in vials. The surfaces of the products make direct contacts with the products so that heat transfers can occur. The refrigerator unit provides cold temperatures to the condenser which, in turn, provides cold temperatures to the surfaces of the freeze dried chamber. Finally, the vacuum pump unit is designed to bring the products to the triple-point (sublimation) temperature ($T_{SUB}$) where ice sublimates into vapours.

In such conventional vacuum freeze-drying apparatus, food products are undergone four different operating stages. In the primary drying stage, the product temperature is firstly decreased in such a way that all the free water freezes. In the secondary drying stage, the product is exposed to low pressure and the ice sublimates. In the post drying phase, or at the end of the sublimation stage, the amount of residual water can be further decreased by removing the bound water. This stage is generally carried out increasing product temperature and decreasing the operating pressure. This way, all the characteristics of the product, e.g. shape, appearance, colour, taste and texture, are retained in the final product.

However, the conventional freeze drying apparatuses is replete with many drawbacks, especially in the industrial applications. One main drawback is the nonuniformity of the cold temperature zones in the freeze dried chamber that cause nonunformity in the final products. Another drawbacks are the cost and efficiency because the energy required by the lyophilazation process is higher with respect to that of other drying devices. Yet another drawback is the lack of automatic controls that lead to difficulties in freeze drying of different products having different properties.

More particularly, conventional industrial-size vacuum freeze drying apparatuses generate non-uniform freezing patterns of temperatures and pressures. That is, within the large refrigerated area, freezing patterns of different temperatures and pressures are formed due to the uneven heat transfer caused either by (1) the forced conduction of the fans or (2) by none at all. The freezing patterns are proportional to the area and the distance of the chamber. The closer to the fans the stronger the heat transfer by the forced conduction. To solve this distribution problem, multiple fans are used to reduce the segmented freezing patterns. However, multiple fans consume more electrical energy, hobbling efficiencies and increasing costs. In addition, pockets of freezing patterns are formed in the overlapping areas between the fans. This problem becomes less severe as the vacuum freezing process proceeds because it takes time for air to diffuse in order to reach equilibrium. However, at the time the temperature and condition inside the condenser reach equilibrium, the freeze dried food batch have changed differently in different sections of the chamber. Therefore, the food products being freeze dried are not uniform. Most of the time, if it takes too long to reach the triple point temperature, the aroma and flavor of foods will be degraded. The taste, the texture, the flavor, and the essence are no longer the same as the original food products.

Furthermore, when multiple fans are used, ice crystals are formed on the fans at the end of the freezing process. Thus, conventional vacuum freeze drying apparatus demands additional heat energy to defrost these ice crystals, thus consuming more energy and degrading the efficiency of the entire process. The efficiency depends on the input energy, the output energy, and the duration of the entire process. If the vacuum freeze drying process is not performed properly, the following problems may occur: (1) when the cooling rate is not sufficiently fast, the formation of large ice crystals can cause the freeze dried products to be brittle and destroy the microscopic structures of product; (2) when the cooling temperature is not below the eutectic temperature ($T_{eu}$), water and unwanted solutes will not be completely removed, rendering the entire process ineffective; (3) when the pressures and temperatures are not carefully controlled, the product may collapse, destroying the essence of the product. In addition, the conventional vacuum freeze driers are largely controlled by human interfaces which cause the above problems; and (4) each product requires different eutectic temperatures ($T_{eu}$), optimal temperatures ($T_{opt}$), pressures, and settings for being properly freeze dried. For example, the freeze drying of water melons is different from that of walnuts because water melon contains more liquid than walnuts. Using generic settings for different products would likely render the freeze drying process of different products ineffective and uneconomical.

Therefore, what is needed is a vacuum freeze drier that can provide a deep and uniform freezing pattern inside the chamber in a relatively short time to capture the essence of the products and to achieve uniformity.

What is needed is a vacuum freeze drier and method that are fully automatic, i.e., controlled and observed by a controller unit or a computer that can create optimal freeze drying conditions for each specific product.

What is needed is a vacuum freeze drier that can provide a high rate of cooling so that the microscopic structures of the product are preserved.

Furthermore, what is needed is a vacuum freeze drying apparatus that can reuse the water vapors to provide heat to the product in the dryer unit so that energy is conserved and the entire vacuum freeze drying process is efficient.

Yet, what is needed is a vacuum freeze drying apparatus that can provide specific settings including eutectic temperatures ($T_{eu}$), optimal temperatures ($T_{opt}$), pressures, and cooling rates for specific fruits having different aqueous sucrose levels so that structural collapse can be avoided.

Finally, what is needed is a method of operating such vacuum freeze drying apparatus so that the above objectives can be achieved.

The vacuum freeze drying apparatus disclosed in the present invention solve the above described problems and objectives.

SUMMARY OF THE INVENTION

Accordingly, an objective of the present invention is to provide a convection current vacuum freeze drying apparatus which includes a dryer chamber unit comprising a plurality of trays for depositing products to be freeze dried; a convection current condenser unit, mechanically connected to the dryer chamber unit, comprising a plurality of first elongate heat exchange tubes each having fins arranged around an outer circumference of the first elongate heat exchange tube; a refrigerator unit mechanically connected to the convection current condenser unit, operable to provide cold temperature to the plurality of elongate heat exchange tubes; a cooling tower unit mechanically connected to the convection current condenser unit; a primary vacuum pump unit, mechanically connected to the convection current condenser unit and the cooling tower unit, operable to provide a vacuum pressure to said convection current condenser unit; and a heater unit mechanically connected to provide a heat energy to both the dryer chamber unit and the convection current condenser unit.

Another objective of the present invention is to provide a method for convection current freeze drying a product using an apparatus including a dryer unit, a ice condenser unit equipped with a plurality of elongate heat exchange tubes having radially arranged fins, a refrigerator unit, a vacuum pump unit, a cooling tower unit, a heater unit, a controller unit, and a database, comprising: selecting specific freeze drying settings of the product stored in the database; loading the specific freeze drying settings into the controller unit for fully controlling of the convection current freeze drying process; performing the convection current freeze drying process which comprises accelerating a freezing rate in the dryer unit by using the plurality of elongate heat exchange tubes having radially arranged fins; determining whether the said convection current freeze drying process is operated in accordance to the specific freeze drying settings using a plurality of sensors and the controller unit, if the specific freeze drying settings are not corrected, then readjusting the specific freeze drying settings using the controller unit, and if the specific freeze drying settings are correct then packaging the product.

Another objective of the present invention is to provide a computer software program stored in a non-transitory memory for operating the convection current vacuum freeze drying apparatus comprising a dryer unit, a ice condenser unit, a refrigerator unit, a vacuum pump unit, a heater unit, a cooling tower unit, a controller unit, and a database; when executed by the controller unit, the computer software program of the present invention performing a process comprising: selecting specific freeze drying settings of the product stored in the database; loading the specific freeze drying settings into the controller unit for fully controlling of the convection current freeze drying process; performing the convection current freeze drying process which comprises accelerating a freezing rate in the dryer unit by using the plurality of elongate heat exchange tubes having radially arranged fins; determining whether the convection current freeze drying process is operated in accordance to the specific freeze drying settings using a plurality of sensors and the controller unit, if the specific freeze drying settings are not corrected, then readjusting the specific freeze drying settings using the controller unit, and if the specific freeze drying settings are correct then packaging the product.

Another objective of the present invention is to achieve a vacuum freeze drying apparatus and process that are fully automatic, i.e., controlled and observed by a controller unit or computer that can create optimal freeze drying conditions.

Another objective of the present invention is to achieve a vacuum freeze drying apparatus and method that can provide a high rate of cooling using heat transfer of natural convection currents between the condenser unit and a plurality of elongate tubes having circumferential fins.

Furthermore, another objective of the present invention is to achieve a vacuum freeze drying apparatus and process that can provide a deep and uniform freezing zone of the same temperature and pressure so that the quality of the food products being freeze dried is uniform.

Yet, another objective of the present invention is to achieve a vacuum freeze drying apparatus and process that can provide specific settings including temperatures, pressures, and cooling rates for products having different aqueous sucrose levels so that structural collapse can be avoided.

Finally, another objective of the present invention is to achieve a computer software program stored in a non-transitory memory that can perform an optimal convection current vacuum freeze drying process for different products when such computer software program is executed by a controller unit.

These and other advantages of the present invention will no doubt become obvious to those of ordinary skill in the art after having read the following detailed description of the preferred embodiments, which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1:
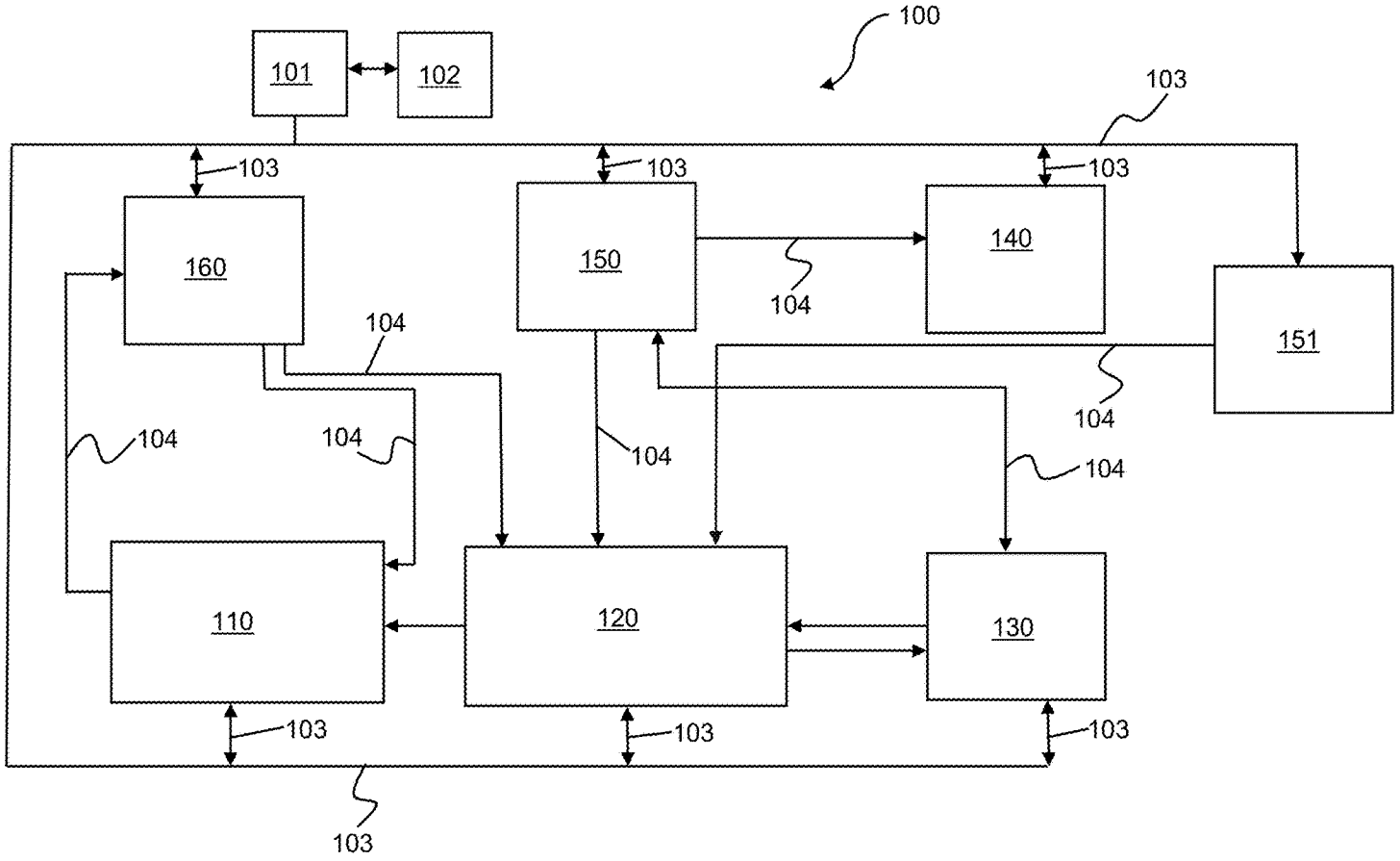
FIG. 1 is a block diagram illustrating a convection current vacuum freeze drying apparatus in accordance with an embodiment of the present invention.

One embodiment of the invention is now described with reference to FIG. 1. FIG. 1 illustrates a block diagram of a convection current vacuum freeze drying apparatus 100 ("apparatus 100") in accordance with an exemplary embodiment of the present invention. Apparatus 100 includes a dryer unit 110, a convection current ice condenser unit 120, a refrigerator unit 130, a cooling tower unit 140, a vacuum pump unit 150, and a heater unit 160, all connected together by mechanical connectors 103. In various embodiments of the present invention, mechanical connectors 103 are hollow tubes of different shapes and sizes that facilitate the flowing of fluids between the units. In some embodiments of the present invention, apparatus 100 also includes a controller unit 101 and a database 102. Database 102 is configured to contain specific vacuum freeze drying settings for different products. Different fruits have been dried using apparatus 100 include, but not limited to, liquid juice and minced fruit chunks. Liquid juice includes such as pineapple juice, cantella juice, durian juice, custard apple juice, yogurt with mixed fruits, sugar cane juice, passion fruit juice, ambarella juice, coconut milk juice, ready to drink coffee, and amaranth juice. Minced fruit chunks include banana, jack fruit, mango, pine apple, durian, and dragon fruits. These listed products have different specific vacuum freeze drying settings including triple point temperatures, eutectic temperatures ($T_{eu}$), drying times, freezing rate, pressure, etc. which are studied beforehand and stored in database 102. When a specific product listed above is selected to be vacuum freeze dried, specific vacuum freeze drying settings stored in database 102 will be loaded into controller unit 101. Afterwards, controller unit 101 uses the specific vacuum freeze drying settings to operate apparatus 100 in accordance to a specific process designed for a specific product. It is noted that other products not mentioned above and their specific vacuum freeze dried settings are also within the scope of the present invention. Yet, in many embodiments of the present invention, mechanical connectors 103 also include sensing devices such as temperature sensors, pressure sensors, flow meters, timing devices, switches, and valves that can communicate with and be controlled by controller unit 101. A detailed description of these sensing devices and an exemplary embodiment of apparatus 100 will be disclosed in FIG. 2.

Continuing with FIG. 1, the main feature of the present invention lies in convection current ice condenser unit 120, controller unit 101, database 102, and the specific operating process for each product listed above. In various embodiments of the present invention, convection current ice condenser unit 120 includes a plurality of first elongate heat exchange tubes with fins arranged around the outer circumference of the first elongate heat exchange tubes so that natural convection currents facilitate the heat exchange between cold airs from refrigerator unit 130, ice condenser unit 120, and dryer unit 110. As a result, the following objectives of the present invention are achieved:

A uniformly distributed and constant cold air is created throughout the entire ice condenser unit 120 and dryer unit 110;

The freezing rate can be exactly controlled;

Foods are vacuum freeze dried homogeneously without undesired quality variations due to location difference as in conventional vacuum freeze drying systems; and Furthermore, since specific vacuum freeze drying settings for different products such as, but not limited to, products listed above can be learned beforehand and stored in database 102, controller unit 101 can execute the vacuum freeze drying process for each product in a precise manner and settings. As such, additional objectives of the present invention are achieved:

The essence of foods is captured at the moment foods are at their best quality. Food quality and essence are changed with time as they are exposed to air. If the vacuum freeze drying is either too slow or too fast, the essence of the vacuum freeze dried product is lost. Equipped with the exact vacuum freeze drying rate, time, and settings and stored them in database 102, controller unit 101 can execute the process to capture foods at their best qualities.

Figure 2:
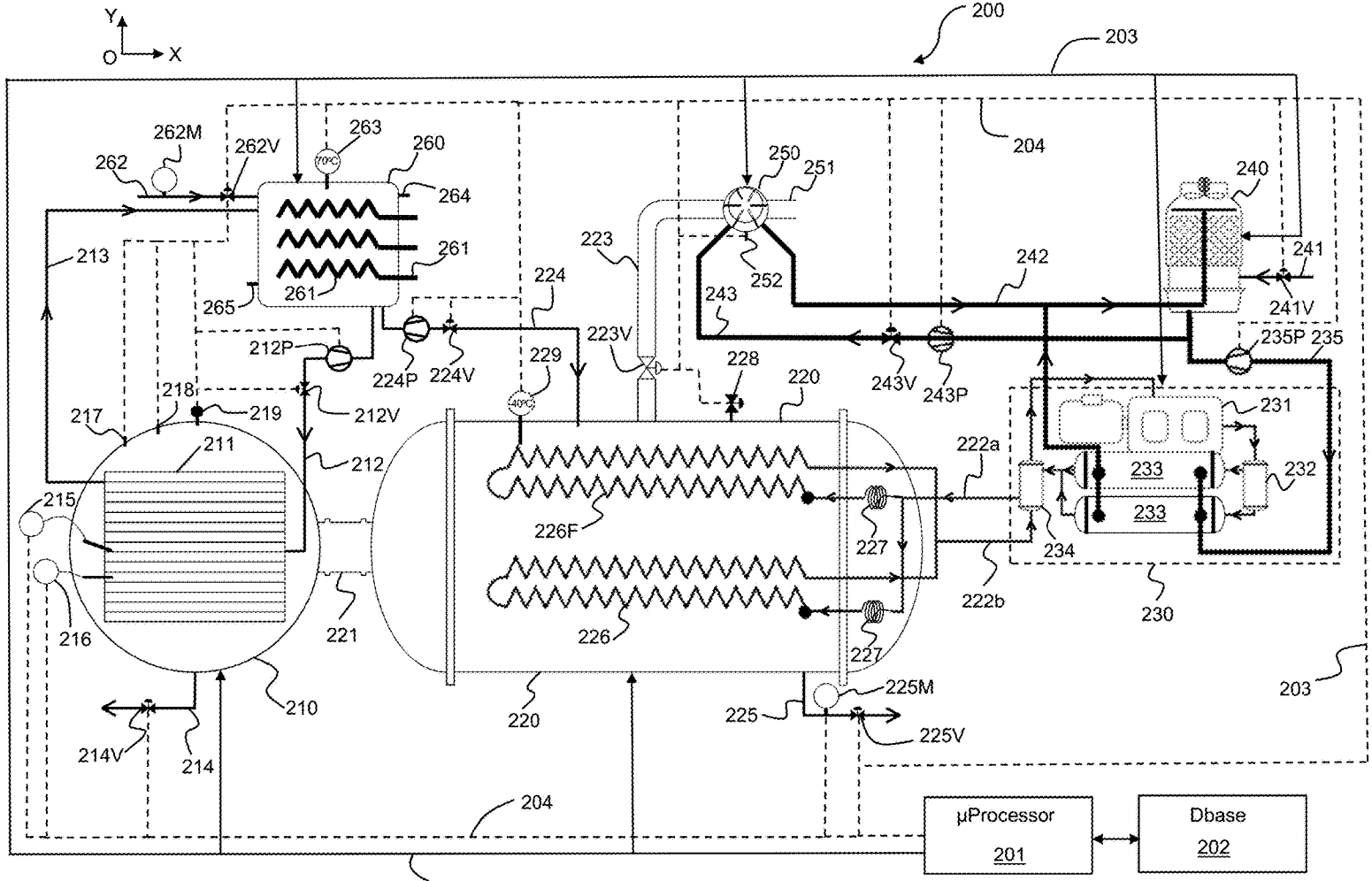
FIG. 2 is a schematic diagram of a convection current vacuum freeze drying apparatus in accordance with an exemplary embodiment of the present invention.

Now referring to FIG. 2, a schematic diagram of a (natural) convection current vacuum freeze drying apparatus ("apparatus") 200 in accordance with an exemplary embodiment of the present invention is illustrated. Convection current vacuum freeze drying apparatus ("apparatus 200") includes a dryer unit 210, a convection current condensing unit (ice condenser unit) 220, a refrigerator unit 230, a cooling tower unit 240, a vacuum pump unit 250, and a heater unit 260. In various embodiments of the present invention, apparatus 200 is not a stand-alone device. It is a network-based device that is connected to a controller unit 201 and a database 202 in a network (not shown). The network can be a WAN, LAN, wireless sensor network (WSN), or a cloud-based network. Furthermore, ice condenser unit 220 includes a plurality of first elongate tubes with fins that accelerate the heat exchange by natural convection currents between the cold temperatures inside ice condenser unit 220 and refrigerator unit 230, providing fast cooling rate and uniformly distributed cold air.

Continuing with FIG. 2, controller unit or computer 201 and database 202 connected to apparatus 200 by communication channels 204. Sensors described below are connected to controller unit 201 by communication channels 204. Communication channels 204 are wireless communication channels such as Wi-fi, Bluetooth, RF, optical, Zigbee, etc. In some embodiments, communication channels 204 maybe data transmission cables such as RS-232, RS-422, or RS-485, etc.

Controller unit 201 serves as the brain of convection current vacuum freeze drying apparatus 200. In some exemplary embodiments, controller unit 201 is a −16 or −32 bit Programmable Logic Controller (PLC), a Supervisory Control and Data Acquisition (SCADA), or any other type of programmable logic array (PLA) consisting of a memory chip and integrated circuits for control logic, monitoring, and communicating. Controller unit 201 directs the programmable logic controller (PLC) and/or to execute control instructions, communicate with other units, carry out logic and arithmetic operations, and perform internal diagnostics. Controller unit 201 runs memory routines, constantly checking the PLC to avoid programming errors and ensure the memory is undamaged. Memory provides permanent storage to the operating system for database 202 used by controller unit 201. Five programming languages are used in controller unit 201 and PLC. They are defined by the international standard IEC 61131. Ladder logic is one of the most commonly used PLC languages. Another programming language is function block diagram (FBD). It describes functions between input and output variables. The function, represented by blocks, connects input and output variables. FBD is useful in depicting algorithms and logic from interconnected controls systems. Structured Text (ST) is a high-level language that uses sentence commands. In ST, programmers can use "if/then/else," "SART," or "repeat/until" statements to create programs. Instruction list (IL) is a low-level language with functions and variables defined by a simple list. Program control is done by jump instructions and sub-routines with optional parameters. Sequential Function Chart (SFC) language is a method of programming complex control systems. It uses basic building blocks that run their own sub-routines. Program files are written in other programming languages. SFC divides large and complicated programming tasks into smaller and more manageable tasks.

Dryer unit 210 includes trays 211, a hot water pipe 212, a freeze dried chamber-heater hot water valve 212V, a freeze dried chamber-heater hot water pump 212P, a return water pipe 213, a discharge water pipe 214, a discharge water valve 214V, a first tray temperature transmitter 215, a second tray temperature transmitter 216, a front door switch 217, a rear door switch 218, a vacuum pressure transmitter 219, all connected as shown in FIG. 2. Freeze dried chamber-heater hot water valve 212V, freeze dried chamber-heater hot water pump 212P, discharge water valve 214V, first tray temperature transmitter 215, second tray temperature transmitter 216, front door switch 217, rear door switch 318, vacuum pressure transmitter 319 are network devices that can communicate with controller unit 201.

Continuing with FIG. 2, convection current condensing unit (ice condenser unit) 220 connects to dryer unit 210 by a large ice condenser and freeze dried chamber connection pipe 221. Ice condenser unit 220 is connected to refrigerator unit 230 via a liquid refrigerant pipe 222*a*, a gaseous refrigerant pipe 222*b*, expansion capillary tubes 227; to vacuum pump unit 250 via a vacuum pipe 223, a vacuum isolating valve 223V; to heater unit 260 via a ice condenser heater hot water pipe 224, a ice condenser heater hot water valve 224V, a ice condenser heater hot water pump 224P, an ice condenser discharge valve 225, an ice condenser discharge flow meter 225M, and an ice condenser discharge valve 225V. Ice condenser unit 220 further includes convection current heat exchanging tubes with fins 226, a vacuum release valve 228, and an ice condenser temperature transmitter 229. In many embodiments, vacuum isolating valve 223V, ice condenser heater hot water valve 224V, ice condenser heater hot water pump 224P, ice condenser discharge valve 225, ice condenser discharge flow meter 225M, and ice condenser discharge valve 225V, vacuum release valve 228, and ice condenser temperature transmitter 229 are network devices controlled by controller unit 201.

Still referring to FIG. 2, refrigerator unit 230 includes a compressor 231, a refrigerant container 232, a liquid refrigerant heat exchanger 233, a refrigerant heat exchanger 234, a cooling water pipe 235, a cooling water pump 235P. Cooling water pump 335B is network device that can be controlled by controller unit 201.

Still referring to FIG. 2, cooling tower unit 240 includes a feed water pipe 241, a feed water valve 241V, a hot water returning pipe 242, a cooling water pipe for vacuum pump unit 243, a cooling water pump for vacuum pump unit 243P, a cooling water valve for vacuum pump unit 243V. Feed water valve 241V, cooling water pipe for vacuum pump unit 243, cooling water pump 243P, a cooling water valve 243V are network devices which can be controlled and communicated to controller unit 201. Vacuum pump unit 250 includes a vacuum input pipe 251 and a current transformer transmitter which is network device. Water heater unit (heater) 260, a three-phase heating element 261, a feed water pipe 362, a feed water flow meter 262M, a feedwater valve 262V, a heater temperature transmitter 263, a high water level sensor 264, and a low water level sensor 265 which are also network devices.

In operation, apparatus 200 is fully controlled by controller unit 201 as described in details in process 600 below. In other words, in various embodiments of the present invention, process 600 including operational steps 601 to 620 are implemented by apparatuses 100 and 200.

Figure 3:
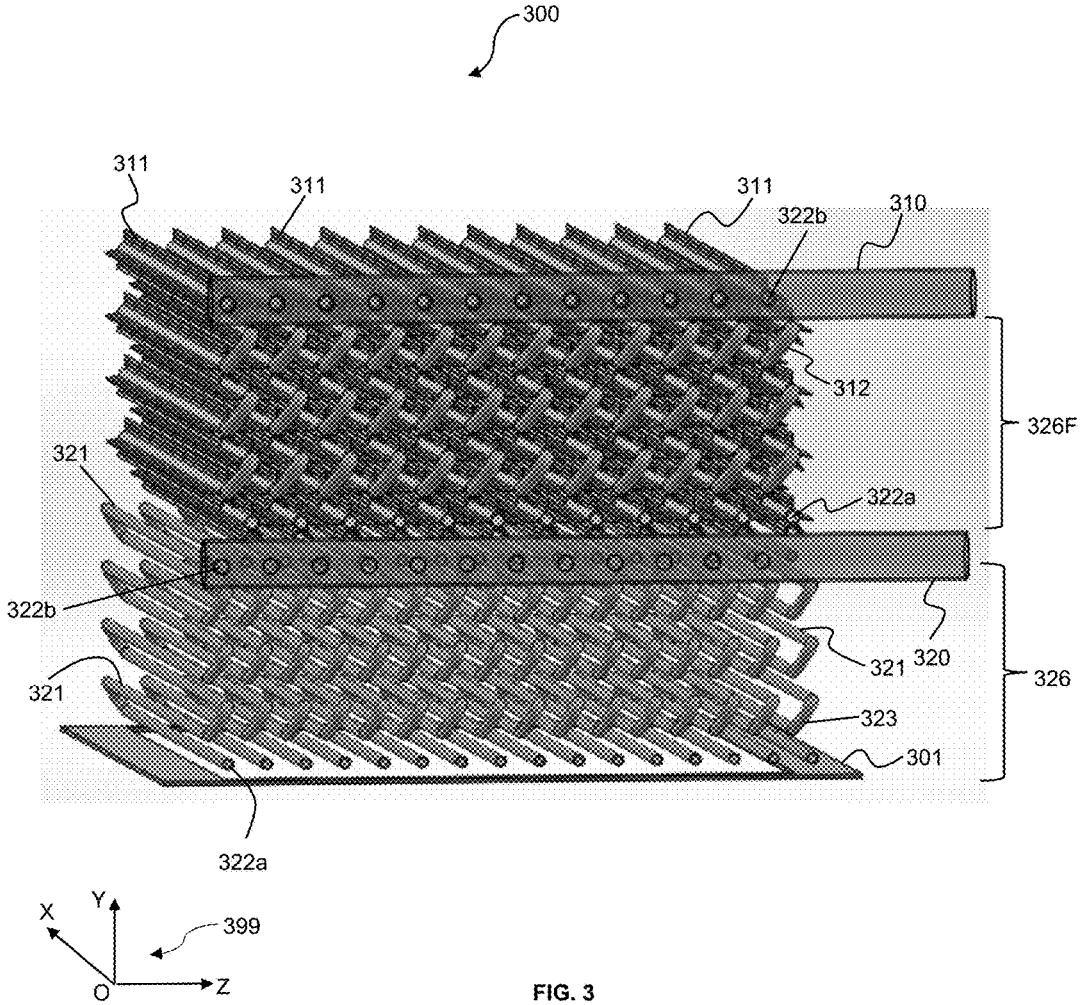
FIG. 3 is a three-dimensional perspective diagram of the internal structure of the ice condenser unit in accordance with an exemplary embodiment of the present invention.

Now referring to FIG. 3, a three-dimensional diagram of the internal structure 300 of the convection current ice condenser unit 220 in accordance with an exemplary embodiment of the present invention is illustrated. Internal structure 300 includes a rectangular base 301 spanning along a horizontal z-direction of an xyz coordinate 399. An array of first elongate heat exchange tubes with fins 326F and an array of second elongate heat exchange tubes without fins 326 are stacked on top of each other and rectangular base 301. Specifically, array of first elongate heat exchange tubes with fins 326F is a three-dimensional M×N array, where M is the number of first elongate heat exchange tubes with fins 311 along the z-direction and N is the number of first elongate heat exchange tubes with fins 311 along the vertical Y direction. Each first elongate heat exchange tubes with fins 311 has a length L spanning along the X direction. In one exemplary embodiment, M is 12, N is 8, and L is 30 mm. In other words, the number of first elongate heat exchange tubes with fins 311 in a row along the Z direction is 12. The number first elongate heat exchange tubes with fins 311 in a column along the Y direction is 8. The length of first elongate heat exchange tubes with fins 311 is 30 mm. Together, the number of first elongate heat exchange tubes with fins 311 in rows Z and in columns Y and their length L form three-dimensional array 326F.

Continuing with FIG. 3, array of second elongate heat exchange tubes without fins 326 is a three-dimensional M×N array, where M is the number of second elongate heat exchange tubes without fins 321 along the z-direction and N is the number of second elongate heat exchange tubes without fins 321 along the vertical Y direction. Each second elongate heat exchange tubes without fins 321 has a length L spanning along the X direction. In one exemplary embodiment, M is 12, N is 8, and L is 30 mm. In other words, the number of second elongate heat exchange tubes without fins 321 in a row along the Z direction is 12. The number second elongate heat exchange tubes without fins 321 in a column along the Y direction is 8. The length of second elongate heat exchange tubes without fins 321 is 30 mm. Together, the number of second elongate heat exchange tubes without fins 321 in rows Z and in columns Y and their length L form three-dimensional array 326.

Figure 4:
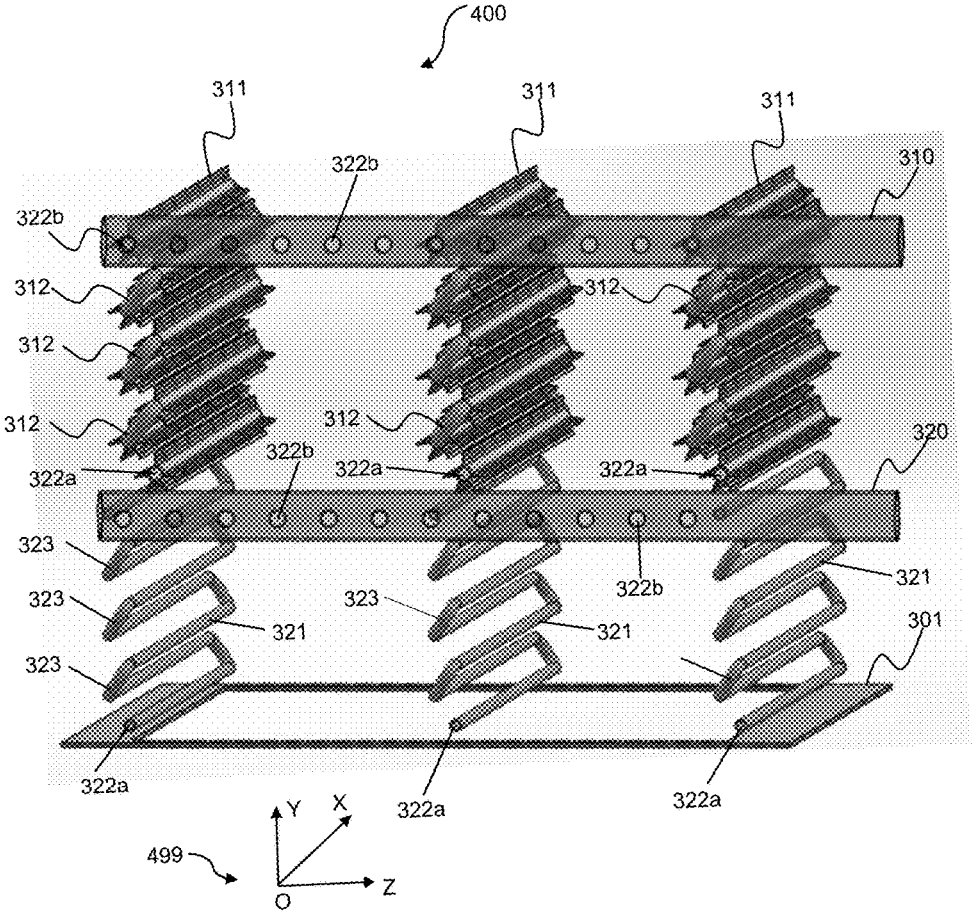
FIG. 4 is a three-dimensional perspective diagram of the vertical zig-zag structure in the columns of the array of the elongate heat exchange tubes in accordance with an exemplary embodiment of the present invention.

Now refer to FIG. 4 and FIG. 3 together. FIG. 4 elucidates a vertical zig-zag structure 400 of three-dimensional array 326F and three-dimensional array 326 of ice condenser unit 220 by eliminating the middle columns along the Y direction. In various embodiments of the present invention, in three-dimensional array 326F, first elongate heat exchange tubes 311 are laid out in a staggered manner along the horizontal Z direction so that all the leftmost first elongate heat exchange tubes 311 are flushed in a vertical straight line in the vertical Y direction (please see XYZ coordinate 499 in FIG. 4). A curved connecting tube 312 connects the distal ends of the top first elongate heat exchange tube 311 and its staggered neighboring first elongate heat exchange tube 311 right below within the first column. Then another curved connecting tube 312 connects the proximate ends of the staggered first elongate heat exchange tube 311 in the second row of the first column to a flushed first elongate heat exchange tube 311 in the third row of the first column. This pattern repeats until a vertical zig-zag structure is formed in three-dimensional array 326F. A top reinforcement plate 310 aligns and reinforces all top first heat exchange tubes 311 where the warm liquid is output 322*b* back to refrigerator unit 230. All bottom first heat exchange tubes 311 are input 322*a* cold gas from refrigerator unit 230.

Similarly, in three-dimensional array 326, second elongate heat exchange tubes 321 are laid out in a staggered manner along the horizontal Z direction so that all the leftmost first elongate heat exchange tubes 321 are flushed in a vertical straight line in the vertical Y direction (please see XYZ coordinate 499 in FIG. 4). A curved connecting tube 323 connects the distal ends of the top first elongate heat exchange tube 321 and its staggered neighboring first elongate heat exchange tube 321 right below within the first column. Then another curved connecting tube 323 connects the proximate ends of the staggered first elongate heat exchange tube 321 in the second row of the first column to a flushed first elongate heat exchange tube 321 in the third row of the first column. This pattern repeats until a vertical zig-zag structure is formed in three-dimensional array 326. A bottom reinforcement plate 320 aligns and reinforces all top first heat exchange tubes 321 where the warm liquid is output 322*b* back to refrigerator unit 230. All bottom first heat exchange tubes 321 are input 322*a* cold gas from refrigerator unit 230.

Figure 5:
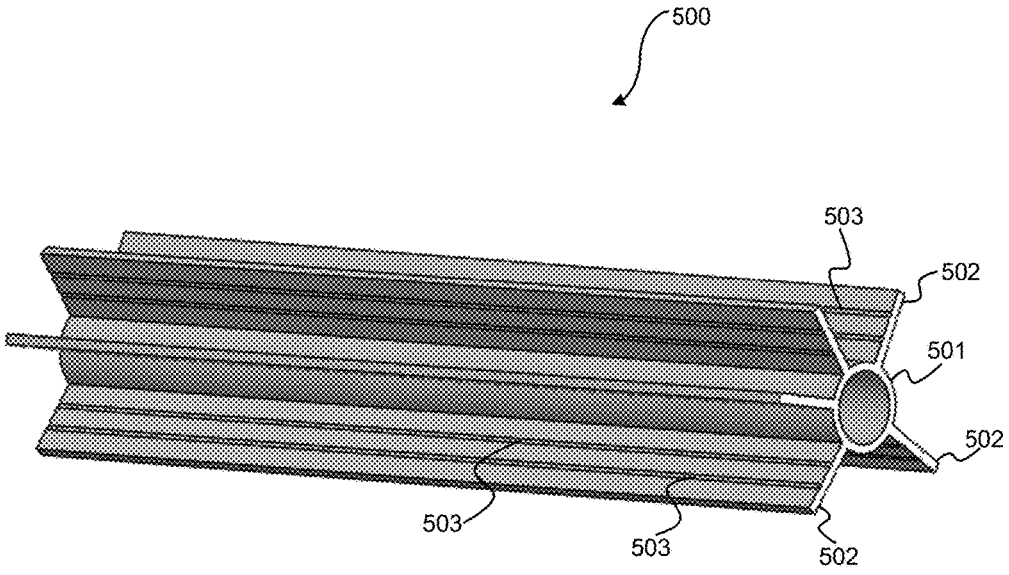
FIG. 5 is a perspective diagram of a first elongate heat exchange tube having radially arranged fins configured to provide convection currents in the natural convection currents in the ice condenser unit in accordance with an exemplary embodiment of the present invention.

Referring now to FIG. 5, a perspective diagram of a first elongate heat exchange tube 500 (tube 500) having radially arranged fins that can provide convection currents in accordance with an exemplary embodiment of the present invention is illustrated. In some embodiments, tube 500—made of aluminum (Al) alloy—has an elongate cylindrical shape. Aluminum alloy has a thermal resistance of 0.4° C./W and a heat transfer coefficient of 59-64 W/m$^{2}$° K. Tube 500 has a diameter of 35 mm and thickness of 3.4 mm. Thus, tube 500 is hollow in the middle so that cold gas can flow through it. Outer circumference of tube 500, rectangular fins 502 whose length spans across the length of tube 500 are arranged radially outward. Each rectangular fin 502 has a width of 30 mm, a length of 2400 mm, and a thickness of 4 mm. A plurality of parallel grooves 503 are formed along the entire length of fins 502. In some embodiments of the present invention, five rectangular fins 502 arranged radially on the outer circumference of each tube 500. Inside ice condenser unit 220, tubes 500 are arranged into 8 rows. Each row has 12 tubes 500. Tubes 500 in a row are separated by an equal distance of 116 mm. Each row is separated by 74 mm. In effect, first elongate heat exchange tube with radially arranged fins 500 has an effective heat exchange area 3.28 times greater than that of second elongate heat exchange tube without fins 321.

When cold refrigerant gas from refrigerating unit 230 is forced through capillary tubes 227, the convection current increases the heat transfer inside ice condenser unit 220. Heat transfer formula is $Q=h_C A_s(T_S-T_A)$. Where $h_C$ is the heat transfer coefficient of fin 502, As is its surface area, $T_S$ is the temperature of tube 500 and fins 502 and $T_A$ is the temperature of the moving air inside ice condenser unit 220. Thus, the more tubes 500 placed in ice condenser unit 220 and the larger the surface area of fins 502 the higher the heat transfer. Parallel grooves 503 creates vortex and increase the velocity of air flowing through each tube 500, thus increasing convection currents and heat exchange rate.

Figure 6:
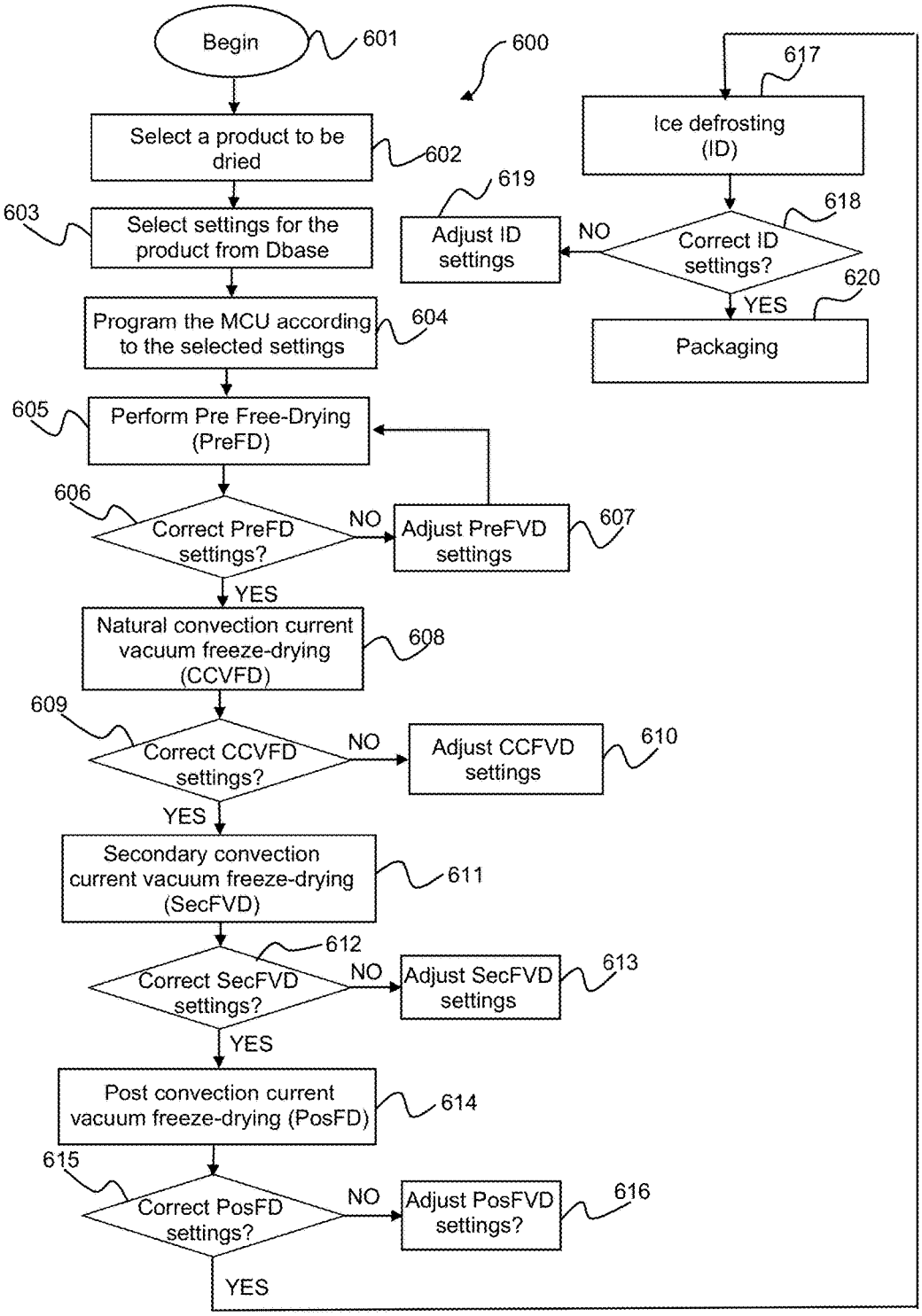
FIG. 6 is a flow chart illustrating a process of operating a convection current vacuum freeze drying apparatus in accordance with an exemplary embodiment of the present invention.

Next referring to FIG. 6, a flow chart illustrating a method 600 of operating convection current vacuum freeze drying apparatus 200 ("apparatus 200") in accordance with an exemplary embodiment of the present invention is illustrated. The operation apparatus 200 illustrated by process 600 further includes the following operational steps: performing the preliminary convection current vacuum free drying (pre CCVFD) 601-604, performing the primary convection current vacuum free drying (pri CCVFD) 605-608, performing secondary convection current vacuum free drying (sec CCVFD) 609-612, performing post convection current vacuum free drying (post CCVFD) 613-616, and performing ice defrosting 617-620.

In the pri CCFVD operational steps 601-604, the refrigerator unit 230 is started to collect cold air inside and dryer unit 210 and ice condenser unit 220. Discharge water valve 214V and ice condenser discharge valve 225V are closed. Cooling water pump for vacuum pump unit 243P and cooling water valve 243V are switched off. The water circulation in dryer unit 210 is closed off. At the same time, freeze dried chamber-heater hot water valve 212V is switched on. Fans in cooling tower unit 240 is turned on. Cooling water pump 235P is also turned on to cool compressors 231. After compressor 231 are turned on, the temperatures of a plurality of elongate heat exchange tubes with radially arranged fins 226 are recorded via temperature transmitter (also known as thermometer or thermal coupler) 229. Controller unit 201 observes whether the temperature is lowered by 5° C. If it does not, alarm signals are sent out. Controller unit 201 sends diagnostic signals to inspect refrigerator unit 230. If refrigerator unit 230 is normal, trays 211 are loaded with a selected product listed in Table 1. In some embodiments of the present invention, conveyors (not shown) will thrust trays 311 loaded with the selected product deep inside dryer unit 210.

At step 601, method 600 begins by cleaning and checking all the electrical as well as mechanical connections between the component units are correct and secured as described in FIG. 1 and FIG. 2 above. All valves, e.g., 212V, 214V, 223V, 225V, 228, 243V, 263V, are released to clear all residual water out of the system and ice defrosting step is performed. In other words, step 601 involves all necessary preparatory steps prior to the vacuum freeze drying process begins. In many aspects of the present invention, step 601 may involve calibration procedure to ensure proper and accurate performance of apparatus 200 in accordance with ISO standards such as ISO 13408. The preparatory steps may include temperature tests such as shelves temperatures tests with and without loads, steam in place (SIP) test to ensure proper sterilization of apparatus 200, and tests for vacuum pump unit 250, etc.

At step 602, a specific product to be vacuum freeze dried is selected. In many aspects of the present invention, product includes, but not limited to, liquid juice and minced fruit chunks. Liquid juice includes such as pineapple juice, cantella juice, durian juice, custard apple juice, yogurt with mixed fruits, sugar cane juice, passion fruit juice, ambarella juice, coconut milk juice, ready to drink coffee, amaranth juice, and kumquat juice. Minced fruit chunks include banana, jack fruit, mango, pine apple, durian, and dragon fruits. In some other implementations of step 602, other food products not listed in Table 1 may be selected. The juices of the selected food products are first substantially extracted using a special grincer device (not described here). The liquid juices are laid in trays 211. Controller unit 201 and database 202 are informed and programmed to perform the next steps accordingly.

Next, at step 603, specific settings for the selected product in step 601 are located from a preconfigured database. The preconfigured database is a database built from careful and thorough prior clinical tests for each type of product. Clinical tests are performed to obtain specific settings include eutectic temperatures ($T_{eu}$), critical temperatures ($T_C$), triple point or sublimation temperatures ($T_{SUB}$), optimal temperatures ($T_{opt}$), pressures, durations for each phase (t sec), etc. for each product. In many aspects of the present invention, step 603 is implemented by database 202. The specific settings for each product are stored in database 202 such as Look-Up Table (LUT); Read and Write memory; CD-ROM; DVD; HD-DVD; Blue-Ray Discs; etc.; semiconductor memory such as RAM, EPROM, EEPROM, etc.; and/or magnetic memory such as hard-disk drive, floppy-disk drive, tape drive, MRAM, etc. A simple exemplary database in accordance with an exemplary embodiment of the present invention is listed in Table 1 below. Please note that Table 1 is only a simplified example of the database of the present invention. In reality, the database can have other settings listed above which are necessary to carry out an optimal convection current freeze drying process for each type of product.

TABLE 1

A Simplified Example of a Vacuum Freeze Drying Database

| Address | Products | Triple Point Temperatures | Pressures |
|---|---|---|---|
| 1 | Pineapple Juice | <−20° C. | <0.5 Torr. |
| 2 | Cantella Juice | <−20° C. | <0.5 Torr. |
| 3 | Durian Juice | <−18° C. | <0.5 Torr. |
| 4 | Custard Apple Juice | <−30° C. | <0.1 Torr. |
| 5 | Yogurt and Mixed Fruits | <−30° C. | <0.1 Torr. |
| 6 | Sugarcane Juice | <−20° C. | <0.2 Torr. |
| 7 | Passion Fruit Juice | <−20° C. | <0.5 Torr. |
| 8 | Ambarella Juice | <−20° C. | <0.2 Torr. |
| 9 | Coconut Milk Juice | <−20° C. | <0.5 Torr. |
| 10 | Ready to Drink Coffee | <−20° C. | <0.5 Torr. |
| 11 | Amaranth Juice | <−20° C. | <0.5 Torr. |
| 12 | Kumquat Juice | <−20° C. | <0.5 Torr. |

TABLE 1-continued

A Simplified Example of a Vacuum Freeze Drying Database

| Address | Products | Triple Point Temperatures | Pressures |
|---|---|---|---|
| 13 | Minced Banana chunks | <−20° C. | <0.5 Torr. |
| 14 | Minced Jack Fruit Chunks | <−20° C. | <0.5 Torr. |
| 15 | Minced Mango Chunks | <−20° C. | <0.5 Torr. |
| 16 | Minced Pineapple Chunks | <−20° C. | <0.5 Torr. |
| 17 | Minced Durian Chunks | <−20° C. | <0.5 Torr. |
| 18 | Minced Dragon Fruit Chunks | <−20° C. | <0.5 Torr. |

Next, at step 604, after all the settings are located in the database, a controller unit is programmed with the above settings. In many exemplary embodiments of the present invention, step 604 is implemented by controller unit 201 which includes, but not limited to, a desktop computer, a laptop computer, a Programmable Logic Controller (PLC), a Supervisory Control and Data Acquisition (SCADA), or any other type of microprocessors or programmable logic array (PLA).

More specifically, in the pri CCFVD operational steps 601-604, the refrigerator unit 230 is started to collect cold air inside and dryer unit 210 and ice condenser unit 220. Discharge water valve 214V and ice condenser discharge valve 225V are closed. Cooling water pump for vacuum pump unit 243P and cooling water valve 243V are switched off. The water circulation in dryer unit 210 is closed off. At the same time, freeze dried chamber-heater hot water valve 212V is switched on. Fans in cooling tower unit 240 is turned on. Cooling water pump 235P is also turned on to cool compressors 231. After compressor 231 are turned on, the temperatures of a plurality of elongate heat exchange tubes with radially arranged fins 226 are recorded via temperature transmitter (also known as thermometer or IoT thermometer) 229. Controller unit 201 observes whether the temperature is lowered by 5° C. If it does not, alarm signals are sent out. Controller unit 201 sends diagnostic signals to inspect refrigerator unit 230. If refrigerator unit 230 is normal, trays 211 are loaded with a selected product listed in Table 1. In some embodiments of the present invention, conveyors (not shown) will thrust trays 311 loaded with the selected product deep inside dryer unit 210.

Continuing with operational steps pre CCVFD 601-604 and FIG. 2, tray temperature transmitters 215 and 216 are moved into position to record tray temperatures during the convection current vacuum freeze drying process. The door (s) of dryer unit 210 are automatically closed by turning on front door switch 217 and rear door switch 218. Sensors will alarm controller unit 201 if doors are not hermetically closed. Cooling water valve 243V and current transformer transmitter 252 are switched on to cool vacuum pump unit 250. Vacuum isolating valve 223V is tightly switched off so that when vacuum pump unit 250 is turned on it will not be overloaded. Controller unit 201 observes when vacuum pump unit 250 is overloaded. If vacuum pump is overloaded, controller unit 201 tightens up vacuum isolating valve 223V and checks for overloading again. Some time-outs can be provided to apparatus 200 during correction steps. This correction repeats until vacuum pump unit 250 is not overloaded. When this condition happens, controller unit 201 turns on vacuum pump unit 250 by 5% per minute until vacuum pump unit 250 is fully throttled on. At this time, the pre CCVFD operational steps 601-604 end.

At step 605, a preliminary convection current vacuum free drying step (pre CCVFD) is performed. In the implementation of step 605, all the valves and flow meters are turned off so that all main units 210 to 260 are isolated from one another. First, heater unit 260 and the vacuum pump unit 250 are turned off because it is not required in the early stages of the process. Meanwhile, ice condenser unit 220, refrigerator unit 230, and cooling tower unit 240 are turned on. Ice condenser unit 220 is slowly set to a temperature less than the initiation temperature of 5° C. Once this initiation temperature is achieved for a first predetermined time duration, a product listed in Table 1 is loaded either manually or by an automatic conveyor which is controlled by controller unit 201. When all trays 211 in dryer unit 210 are finished loading, vacuum pump unit 250 is turned on. Cooling tower valve 243V and vacuum pump isolating valve 223V are turned off. Next, a second predetermined time duration is set by controller unit 201. Finally, vacuum pump unit 250 is checked for overloading. If vacuum pump unit 250 is overloaded, controller unit 201 will reset the second predetermined time duration until the overloading condition is cleared. Then, vacuum pump isolating valve 223V connecting vacuum pump unit 250 and ice condenser unit 220 is slowly opened at a predetermined rate of approximately 5% per minute until this vacuum pump isolation valve 223V is fully opened. Thus, the objective of the pre CCVFD operational step is to set up the initial temperature (less than 5° C.) and slowly turning on vacuum pump unit 220 at a predetermined rate of 5% per minute.

At step 606, the initiation temperature, the first predetermined time duration, the second predetermined time duration, the rate, and other settings of the preliminary convection current vacuum free drying are sensed by sensors and sent to a controller unit. The controller unit compares these observed setting data with those stored in the database and determines whether the preliminary CCVFD is performed correctly. In many embodiments of the present invention, step 606 can be implemented by controller unit 201, database 202, and sensors such as, 215, 216, 219, 225M, 229, 252, 262M, 263, 264, etc. which can be observed remotely by devices such as cell phones, laptops, computers, etc. that are connected to the network. In a preferred embodiment, convection current vacuum freeze drying apparatus 200 of the present invention is network-based. In some embodiments, convection current vacuum freeze drying apparatus 200 of the present invention is a stand-alone machine which is not connected to any network.

At step 607, the settings of the preliminary CCVFD is sensed by the sensors. Similar to step 606, the sublimation temperature ($T_{SUB}$), the third predetermine time duration, the state of the valves are constantly observed. In many embodiments of the present invention, all sensors are network-based devices. Step 607 can be implemented by, controller unit 201, database 202, sensors such as, 215, 216, 219, 225M, 229, 252, 262M, 263, 264, etc. that are connected to a network such as the industrial wireless sensor network (IWSN).

Next at step 608, a primary convection current vacuum free drying (pri CCVFD) operational step is performed. In the primary convection current vacuum drying operational step, the controller unit brings the ice condenser unit well below the triple point (sublimation) temperature of the product for a third predetermined time duration. Please see Table 1. As an example, if a fruit product is selected, the sublimation temperature ($T_{SUB}$) is maintained at −20° C. for 11 hours. A vacuum pipe connecting the ice condenser unit and the vacuum pump unit is turned off so that the cold vapors from the ice condenser unit are prevented from entering the vacuum pump unit. It will be noted that the eutectic temperatures ($T_{eu}$) of the products are taken into consideration by the controller unit to avoid eutectic melt down of the product. Step 608 can be implemented by controller unit 201, database 202, vacuum freeze dried chamber 210, ice condenser unit 220, refrigerator unit 230 of apparatus 200 described above in FIG. 2.

In the implementations of steps 605-608, the temperatures on convection current heat exchange tubes with fins 326 are lowered and maintained at −20° C. The pressure inside ice condenser unit 220 is lowered to less than 5 Torricelli (torr.). This temperature and pressure are checked at a predetermined time duration of 10 minutes interval. Current intensities of current transformer transmitter 252 are reported. Tray temperatures from tray temperature transmitters 215 and 216 are also observed.

If the process proceeds normally, at −20° C. and 5 Torr., the water in the product in trays 311 will be frozen solid for about an hour. Then, valve 212V is turned on to circulate hot water to pipes (not shown) underneath trays 211 in order to bring the tray temperature to 5° C. for 11 hours. This time duration depends on the type of product being freeze dried. See Table 1. Controller unit 201 searches database 202 to select the correct this time duration for each product. During this time duration, all frozen water will be transformed directly to gaseous phase without becoming liquid first.

At step 609, the settings of the primary CCVFD is sensed by the sensors. Similar to step 608, the sublimation temperature, the third predetermine time duration, the state of the valves are constantly observed. In many embodiments of the present invention, step 609 can be implemented by controller unit 201, database 202, and sensors such as, 215, 216, 219, 225M, 229, 252, 262M, 263, 264, etc.

At step 610, if any of the settings is not correct, the controller unit or any devices that are connected to the network can alarm and adjust the settings so that the optimal primary CCVFD results can be achieved. In many embodiments of the present invention, step 610 can be implemented by controller unit 201, database 202, and sensors such as, 215, 216, 219, 225M, 229, 252, 262M, 263, 264, etc.

At step 611, after correct the settings of the primary CCVFD, the controller unit continues step 611. A time-out may be imposed on the system until all incorrect settings are adjusted. In many embodiments of the present invention, step 611 can be implemented by controller unit 201.

At step 612, secondary convection current vacuum freeze drying (sec CCVFD) step is performed. In this step, the pressure is lowered to the triple point (sublimation) and a fourth time duration is set. In the case of fruit product is being freeze dried this fourth time period is 10 minutes. Then the tray temperatures are increased by 5° C. step by a fifth time duration of about 30 minutes. Finally, tray temperatures are held at 5° C. for a sixth predetermine time duration of about 8 hours so that all remaining frozen solutes in the product change directly into vapor phases without becoming liquid. In step 612, heater unit is turned on and the all the valves are connecting the dryer unit and the heater unit are opened. Step 612 can be implemented by controller unit 201, database 202, vacuum freeze dried chamber 210, ice condenser unit 220, refrigerator unit 230, cooling tower unit 240, vacuum pump unit 250, and heater unit 260 of apparatus 200 described above in FIG. 2.

At step 613, the settings of the secondary CCVFD is sensed by the sensors. Similar to step 612, the sublimation temperatures ($T_{SUB}$), pressures, tray temperatures, and the predetermine time durations are constantly observed. In many embodiments of the present invention, step 613 can be implemented by controller unit 201, database 202, and sensors such as, 215, 216, 219, 225M, 229, 252, 262M, 263, 264, etc.

To summarize steps 610-613, operation step (sec CCVFD) is very similar to the pri CCVFD steps 604-609 except that the temperatures inside dryer unit 210 are increased to about 65° C. by turning on the circulation of hot water from heater unit 260. Trays 211 are heated up by the vapors from the product during the convection current vacuum freeze drying process. The sec CCVFD step aims is to vaporize the remaining water from the product.

Now referring to step 614, a post convection current vacuum freeze drying (post CCVFD) operational step is performed. In this step, the refrigerator unit, the vacuum pump unit, the cooling tower unit are turned off in that specific order for a seventh predetermined time duration prior to the release of the vacuum unit valve to avoid damaging the dried product. In many aspects of the present invention, step 614 can be implemented by controller unit 201, database 202, vacuum freeze dried chamber 210, ice condenser unit 220, refrigerator unit 230, cooling tower unit 240, vacuum pump unit 250, and heater unit 260 of apparatus 200 described above in FIG. 2.

At step 615, the settings of the post CCVFD is sensed by the sensors. Similar to step 612, the temperatures, flow meters, pressures, and the predetermine time durations are constantly observed. In many embodiments of the present invention, step 615 can be implemented by controller unit 201, database 202, and sensors such as, 215, 216, 219, 225M, 229, 252, 262M, 263, 264, etc.

At step 616, if any of the settings is not correct, the controller unit or any devices that are connected to the network can alarm and adjust the settings so that the optimal post CCVFD results can be achieved. After correct the settings of the post CCVFD, the controller unit continues step 609. A time-out may be imposed on the system until all incorrect settings are adjusted. In many embodiments of the present invention, step 616 can be implemented by controller unit 201, database 202, and sensors such as, 215, 216, 219, 225M, 229, 252, 262M, 263, 264, etc.

Post convection current vacuum freeze drying (post CCVFD) steps 613-616 are performed in apparatus 200. First, vacuum isolating valve 223V is turned off to prevent oils of vacuum pump unit 250 from entering ice condenser unit 220. Compressors 231 and cooling water pump 235P are switched off. Then freeze dried chamber-heater hot water valve 212V and freeze dried chamber heater hot water pump 212P are turned off. Cooling water pump 243P is turned off. At this moment, heater unit 260 ceases to provide heat energy to dryer unit 210. Thirty seconds (30 seconds) from the time vacuum isolating valve 223V is completely turned off, vacuum pump unit 250 is turned off. Cooling water valve 343V is turned off and and cooling water pump 243 is locked. Then fans in cooling tower unit 240 are turned off. Vacuum release valve 228 is opened to bring the pressure inside ice condenser unit 220 to the atmospheric pressure (1 atm). A one-minute time-out is given to apparatus 200 before discharge water valve 214V is opened. Front door switch 217 and rear door switch 218 are released. Vacuum freeze product can now be collected and packaged. Now, controller unit 201 can calculate the amount of water extracted from product by subtracting the amount of water recorded on flow meter 225M from that on flow meter 262M.

In some implementations, method 600 may include step 617, an ice defrosting (ID) operational step is performed. In this step, water vapors from the product after sublimation is forwarded to the heater unit to use the latent heat to defrost the ice crystals formed on the fins of the heat exchange tubes.

At step 618, the settings of the ID are sensed by the sensors. Similar to step 602, the temperatures of the heater unit are sensed. In many aspects of the present invention, step 618 can be implemented by controller unit 201, database 202, vacuum freeze dried chamber 210, ice condenser unit 220, refrigerator unit 230, cooling tower unit 240, vacuum pump unit 250, and heater unit 260 of apparatus 200 described above in FIG. 2.

At step 619, if any of the settings is not correct, the controller unit or any devices that are connected to the network can alarm and adjust the settings so that the optimal defrosting results can be achieved. In many embodiments of the present invention, step 619 can be implemented by controller unit 201, database 202, and sensors such as, 215, 216, 219, 225M, 229, 252, 262M, 263, 264, etc.

At step 620, after correct the settings of the ID, the controller unit continues step 618. A time-out may be imposed on the system until any of the incorrect settings are adjusted and all the ice are cleared. In many embodiments of the present invention, step 620 can be implemented by controller unit 201.

Still referring to FIG. 6, next ice defrosting (ID) steps 617-620 are performed in apparatus 200. First, water level of heater unit 360 is measured by high water level sensor 264 and low water level sensor 265. If the water level is low, water can be refilled via feed water tube 262 and feed water valve 262V. Three-phase heating elements 261 of heater unit 260 are turned on to defrost all the ice in ice condenser unit 220. The temperature or amount of heat to defrost depend on the amount of ice formed inside ice condenser unit 220. In some situations, this temperature can reach 90° C. After the ice defrosting operation is complete, three-phase heating elements 261 are turned off. Circular heat water pump 224P is turned off. The efficiency of the convection current vacuum freeze drying process can be calculated by subtracting the amount of input water provided to heater unit 260 measured on flow meter 262M from the amount of output water measured on flow meter 225M.

Finally at step 621, the entire convection current vacuum freeze drying process 100 ends.

Implementations of process 600 disclosed above achieve the following objectives:

A precise step-by-step procedure including predetermined time durations, temperatures, pressure, flow rate, cooling rates are constantly observed and adjusted to that optimal vacuum freeze drying process can be achieved for each type of product.

A fully automatic and control with minimal human involvements so that errors can be avoided, good dried products can be guaranteed, and efficiency can be achieved.

High cooling rate is achieved due to the use of the natural convection currents of the present invention.

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a apparatus, such that the instructions, which execute via the processor of the computer or other programmable data processing apparatus, create means for implementing the functions/acts specified in the flowchart and/or block diagram block or blocks.

Computer program code for carrying out operations for aspects of the present invention such as process 600 may be written in any combination of one or more programming languages, including an object oriented programming language such as Python, Java, Smalltalk, C++, Ladder logic, FBD, ST, IL, SFC, or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The disclosed flowchart and block diagrams illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

DESCRIPTION OF NUMERALS

100 Convection Current Vacuum Freeze Dryer (CCVFD)
101 Controller unit or computer
102 Database
103 Mechanical connectors between units of the CCVFD
104 Communication channels between controller unit and the CCVFD
110 Dryer unit
120 Ice condenser unit
130 Refrigerator unit
140 Cooling tower unit
150 Vacuum pump unit
151 Supplemental vacuum pump unit
160 Heater unit

200 An exemplary convection vacuum freeze drying apparatus
201 Controller unit of the exemplary CCVFD
202 Database of the exemplary CCVFD
203 Mechanical connectors between units of the exemplary CCVFD
204 Communication channels of the exemplary CCVFD
211 Freeze Dried Trays (trays)
212 Hot water pipe
212V Freeze dried chamber-heater hot water valve
212P Freeze dried chamber-heater hot water pump
213 Return water pipe
214 Discharge water pipe
214V Discharge water valve
215 First tray temperature transmitter
216 Second tray temperature transmitter
217 Front door switch
218 Rear door switch
219 Vacuum pressure transmitter
220 Convection current condensing unit (Condenser)
221 Large ice condenser and freeze dried chamber connection pipe
222*a* Liquid refrigerant pipe
222*b* Gaseous refrigerant pipe
223 Vacuum pipe
223V Vacuum isolating valve
224 Ice condenser heater hot water pipe
224V Ice condenser heater hot water valve
224P Ice condenser heater hot water pump
225 Ice condenser discharge valve
225M Ice condenser discharge flow meter
225V Ice condenser discharge valve
226 Convection current heat exchanging tubes with fins
227 Expansion capillary tubes
228 Vacuum release valve
229 Ice condenser temperature transmitter
230 Refrigerator unit
231 Compressor
232 Refrigerant container
233 Liquid refrigerant heat exchanger
234 Refrigerant heat exchanger
235 Cooling water pipe
235P Cooling water pump
240 Cooling tower unit
241 Feed water pipe
241V Feed water valve
242 Hot water returning pipe
243 Cooling water pipe for vacuum pump unit
243P Cooling water pump for vacuum pump unit
243V Cooling water valve for vacuum pump unit
250 Vacuum pump unit
251 Vacuum input pipe
252 Current transformer transmitter of the vacuum pump unit
260 Water heater unit (heater)
261 Three-phase heating element
262 Feed water pipe for heater
262M Feed water flow meter for heater
262V Feedwater valve for heater
263 Heater temperature transmitter
264 High water level sensor
265 Low water level sensor
300 Internal structure of convection current ice condenser unit
301 Rectangular base
310 Input reinforcement plate for top array
311 First elongate heat exchange tube with fins
312 Curved connecting tubes for top array
320 Input reinforcement plate for bottom array
322 Second elongate heat exchange tube without fins
322*a* Cold gas input from the refrigerator unit
322*b* Warm liquid output
323 Curved connecting tube for bottom array
326 Bottom array of second elongate heat exchange tubes
326F Top array of first elongate heat exchange tubes
400 Vertical zig-zag structure of heat exchange tubes
500 First elongate heat exchanging tubes with fins
501 Elongate tube
502 Fins
503 Longitudinal grooves on fins

What is claimed is:

1. A convection current vacuum freeze drying apparatus, comprising:

a dryer chamber unit comprising a plurality of trays for depositing products to be freeze dried;

a convection current condenser unit, mechanically connected to said dryer chamber unit, comprising a plurality of first elongate heat exchange tubes, each of said plurality of first elongate heat exchange tubes having fins arranged around an outer circumference of each of said plurality of first elongate heat exchange tubes, wherein said plurality of first elongate heat exchange tubes substantially fill the internal volume of said convection current condenser unit;

a refrigerator unit mechanically connected to said convection current condenser unit, operable to provide a cold refrigerant gas to said plurality of elongate heat exchange tubes;

a cooling tower unit mechanically connected to said convection current condenser unit;

a primary vacuum pump unit, mechanically connected to said convection current condenser unit and said cooling tower unit, operable to provide a vacuum pressure to said convection current condenser unit; and a heater unit mechanically connected to provide a heat energy to both said dryer chamber unit and said convection current condenser unit.

2. The convection current vacuum freeze drying apparatus of claim 1 further comprising:

a controller unit; and a database electrically coupled to communicate with said controller unit, wherein said controller unit is electrically coupled to control and receive sensed operational settings from said dryer chamber unit, said convection current condenser unit, said refrigerator unit, said cooling tower unit, said principle vacuum pump unit, and said heater unit, wherein said database is configured to store predetermined operational settings and wherein said controller unit is operable to compare said sensed operational settings and said predetermined operational settings.

3. The convection current vacuum freeze drying apparatus of claim 1 further comprising an auxiliary vacuum unit mechanically connected to said convection current condenser unit and said controller unit.

4. The convection current vacuum freeze drying apparatus of claim 1 further comprising a plurality of sensors, wherein said plurality of sensors further comprise thermometers, pressure sensors, timing devices, pumps, valves, and flow meters.

5. The convection current vacuum freeze drying apparatus of claim 1 wherein said controller unit further comprises a desktop computer, a laptop computer, a programmable logic controller (PLC), and a supervisory control and data acquisition (SCADA).

6. The convection current vacuum freeze drying apparatus of claim 4 wherein said apparatus is connected to a network and said controller unit communicates with said plurality of sensors via a first communication channel and wherein said controller unit performs a convection current freeze drying process via a second communication channel.

7. The convection current vacuum freeze drying apparatus of claim 1 wherein said plurality of first elongate heat exchange tubes forms a three-dimensional N×M×L array of first elongate heat exchange tubes, where N is a number of said plurality of first elongate heat exchange tubes arranged in a first direction and M is a number of said plurality of first elongate heat exchange tubes arranged in a second direction, and each of said plurality of first elongate heat exchange tubes has is straight with a length L extended in a third direction, wherein said L, M, and N are non-zero integers.

8. The convection current vacuum freeze drying apparatus of claim 7 wherein each column of said three-dimensional N×M×L array comprises a vertical zig-zag heat exchange tubes formed by said N of said plurality of first elongate heat exchange tubes.

9. The convection current vacuum freeze drying apparatus of claim 8 wherein each of said vertical zig-zag heat exchange tubes are arranged in a horizontally staggered manner and strung together by first curved connecting tubes which alternatively connect two proximate ends and two distal ends of two adjacent said plurality of first elongate heat exchange tubes so that said vertical zig-zag elongate tubes are configured to receive a cold refrigerant gas from said refrigerator unit via said vertical zig-zag tubes located at the bottom row of said N×M×L matrix and to output a warm refrigerant liquid back to said refrigerator unit via said vertical zig-zag tubes located at the bottom row of said N×M×L matrix.

10. The convection current vacuum freeze drying apparatus of claim 9 wherein said convection current condenser unit further comprises a three-dimensional M×N×L array of a plurality of second elongate tubes without fins, wherein said three-dimensional M×N×L array of said plurality of first elongate tubes is fixed on top of said M×N×L array of said plurality of second elongate tubes without fins.

11. The convection current vacuum freeze drying apparatus of claim 10 wherein each column of said three-dimensional N×M×L array of a plurality of second elongate tubes without fins comprises N of said plurality of second elongate heat exchange tubes without fins arranged in a horizontally staggered manner and strung together by second curved connecting tubes which alternatively connect two consecutive proximate ends and two consecutive distal ends of two adjacent of said plurality of second elongate heat exchange tubes without fins so as to form second vertical zig-zag elongate tubes configured to receive a cold refrigerant gas from said refrigerator unit via said second vertical zig-zag elongate tubes located at the bottom row of said N×M×L array and output a warm refrigerant liquid back to said refrigerator unit via said second vertical zig-zag elongate tubes located at the top row of said N×M×L array of said three-dimensional N×M array.

12. The convection current vacuum freeze drying apparatus of claim 11 wherein M equals to 8 and N equals to 12 and wherein each of said plurality of first elongate heat exchange tubes has a length of 30 mm.

13. The convection current vacuum freeze drying apparatus of claim 12 wherein said cylindrical tube is made of an aluminum alloy and has a circumference of 89.9 mm, a radius of 35 mm and a thickness of 3.4 mm and wherein said rectangular fin has a width of 30 mm and a length of 30 mm and a thickness of 4 mm.

14. The convection current vacuum freeze drying apparatus of claim 13 wherein each of said plurality of first elongate heat exchange tubes further comprises a cylindrical tube and five rectangular fins arranged around an outer circumference of said cylindrical tube, wherein one of said five rectangular fins is located on top of said cylindrical tube and four rectangular fins are arranged on lateral sides of said cylindrical tube pointing downward so as to prevent ice and water from being collected on said cylindrical tube.

15. A method of operating a convection current vacuum freeze drying apparatus including a controller unit, a database storing specific freeze drying settings for different products, a drying chamber unit, an ice condenser unit having a plurality of elongate heat exchange tubes with fins that substantially occupies an internal volume of said ice condenser unit, a refrigerator unit, a cooling tower unit, a main vacuum pump unit, an auxiliary vacuum pump unit, a heater unit, said method comprising:

loading said specific freeze drying settings for a specific product from said database into said controller unit, whereupon said controller unit is operable to cause said convection current vacuum freeze drying apparatus to perform the following operational steps:

performing a preliminary convection current vacuum freeze drying step which includes turning on said cooling tower unit, turning on said refrigerator unit by a rate of 5° C./minute, loading said products, avoid overloading of said vacuum pump unit, and turning on said vacuum pump unit at a rate of 5%/minute;

performing a primary convection current vacuum freeze drying step by lowering the temperature and pressure to a sublimation triple point temperature;

performing a secondary convection current vacuum freeze drying step by increasing the temperature to further dry said product; and performing a post convection current vacuum freeze drying step by increasing said pressure and lowering said temperature to an ambient condition.

16. The method of claim 15 wherein performing said primary convection current vacuum freeze drying step further comprising increasing the freezing rate to accelerate lowering the temperature of said product to a triple point (or sublimation) by using natural convection currents created by said plurality of elongate heat exchange tubes with fins.

17. The method of claim 15 wherein performing said primary convection current vacuum freeze drying step further comprising accelerating lowering the pressure inside said ice condenser unit by using said auxiliary vacuum pump unit in addition to said primary vacuum pump unit.

18. The method of claim 15 wherein performing said secondary convection current vacuum freeze drying step further comprises increasing the temperature to said product inside said dryer unit by circulating hot water vapors from said heater unit by means of a plurality of tubes directly contacted metal surfaces where said products are deposited.

19. The method of claim 15 wherein said operational steps further comprises an ice defrosting step by increasing the temperature inside said ice condenser unit to defrost all ice formation on said plurality of first elongate heat exchange tubes.

20. sensing real-time freeze drying settings for each of said preliminary convection current vacuum freeze drying step, said primary convection current vacuum freeze drying step, said secondary convection current vacuum freeze drying step, and said post convection current vacuum freeze drying step, wherein said specific freeze drying settings further comprise temperatures, pressures, predetermined time durations, flow rates, pump rates, open or close states of valves, and freezing rates; and comparing said real-time freeze drying settings with said specific freeze drying settings stored in said database, if said real-time vacuum freeze drying settings are different from said specific vacuum freeze drying settings than predetermined levels, adjusting said real-time vacuum freeze drying settings; otherwise, continuing said operational steps.

* * * * *